US007041041B1

(12) United States Patent
Evans

(10) Patent No.: US 7,041,041 B1
(45) Date of Patent: May 9, 2006

(54) EXERCISE EQUIPMENT

(75) Inventor: Robert Scott Evans, 10858 Nassau Ave., Sunland, CA (US) 91040

(73) Assignee: Robert Scott Evans, Sunland, CA (US)

( * ) Notice: Subject to any disclaimer, the term of this patent is extended or adjusted under 35 U.S.C. 154(b) by 278 days.

(21) Appl. No.: 10/394,366

(22) Filed: Mar. 21, 2003

Related U.S. Application Data

(60) Provisional application No. 60/366,559, filed on Mar. 21, 2002.

(51) Int. Cl.
*A63B 21/045* (2006.01)

(52) U.S. Cl. ..... 482/126; 482/121; 482/127

(58) Field of Classification Search ..... 482/110, 482/121, 122, 124–127; D21/692–693
See application file for complete search history.

(56) References Cited

U.S. PATENT DOCUMENTS

| | | | | | |
|---|---|---|---|---|---|
| 192,338 | A | * | 6/1877 | Marshall | 482/126 |
| 3,958,803 | A | * | 5/1976 | Geisselbrecht | 482/126 |
| 4,451,035 | A | * | 5/1984 | Manzi | 482/126 |
| 4,620,704 | A | | 11/1986 | Shifferaw | |
| 4,690,401 | A | * | 9/1987 | Cho | 482/122 |
| 4,725,057 | A | | 2/1988 | Shifferaw | |
| 5,004,226 | A | * | 4/1991 | Brown, Jr. | 482/126 |
| 5,123,886 | A | * | 6/1992 | Cook | 482/129 |
| D488,198 | S | * | 4/2004 | Evans | D21/692 |
| 6,872,174 | B1 | * | 3/2005 | Benach | 482/121 |
| D506,515 | S | * | 6/2005 | Evans | D21/692 |
| 2004/0166999 | A1 | * | 8/2004 | Dodge et al. | 482/121 |
| 2005/0037904 | A1 | * | 2/2005 | Chang et al. | 482/122 |
| 2005/0209071 | A1 | * | 9/2005 | Liang et al. | 482/123 |

FOREIGN PATENT DOCUMENTS

| | | | | |
|---|---|---|---|---|
| DE | 3222774 | A1 | * | 12/1983 |
| DE | 3231228 | A1 | * | 2/1984 |
| JP | 2003144576 | A | * | 5/2003 |

* cited by examiner

*Primary Examiner*—Stephen K. Cronin
*Assistant Examiner*—Victor K. Hwang
(74) *Attorney, Agent, or Firm*—McDonnell, Boehnen, Hulbert & Berghoff LLP

(57) ABSTRACT

The instant invention provides a portable, compact and easy held exercise apparatus that uses two or more resilient members, a securing structure surrounding the resilient members and at least two straps, each attached to one resilient member, to provide flexing resistance exercises to a number of muscle groups of the body.

4 Claims, 1 Drawing Sheet

EXERCISE EQUIPMENT

This application claims benefit of priority under 35 U.S.C. 119(e) to provisional application Ser. No. 60/366,559, filed Mar. 21, 2002.

FIELD OF THE INVENTION

The present invention relates to exercising devices, particularly to the type of personal exercising apparatus using resilient loading elements.

DESCRIPTION OF THE PRIOR ART

There is a multitude of exercising devices and machines that are available today, however, most are large relatively immobile stand-alone machines, such as stationary bikes, treadmills, stair steppers and various weight machines. Of the type of exercise machine using resilient loading elements, these are described in U.S. Pat. Nos. 4,620,704 and 4,725,057. The resilient loading machines are large floor mounted devices that require a system of cables and pulleys for operation. The disadvantages of such equipment is its large size, complicated design, multiple moving parts and lack of portability. There is thus a need to have a less complicated, inexpensive and portable exercise device.

OBJECTS AND ADVANTAGES OF THE PRESENT INVENTION

Accordingly, some of the objects of my invention include providing an inexpensive, portable exercise device that uses resilient members for developing various groups of muscles, as well as providing a number of aerobic exercises. Isotonic and stretching exercises are also possible with exercise devices of my invention. These and other objects and advantages of my invention will become apparent from a reading of the following description drawings and claims.

DETAILED DESCRIPTION OF THE INVENTION

Figures 1, 2, 3:
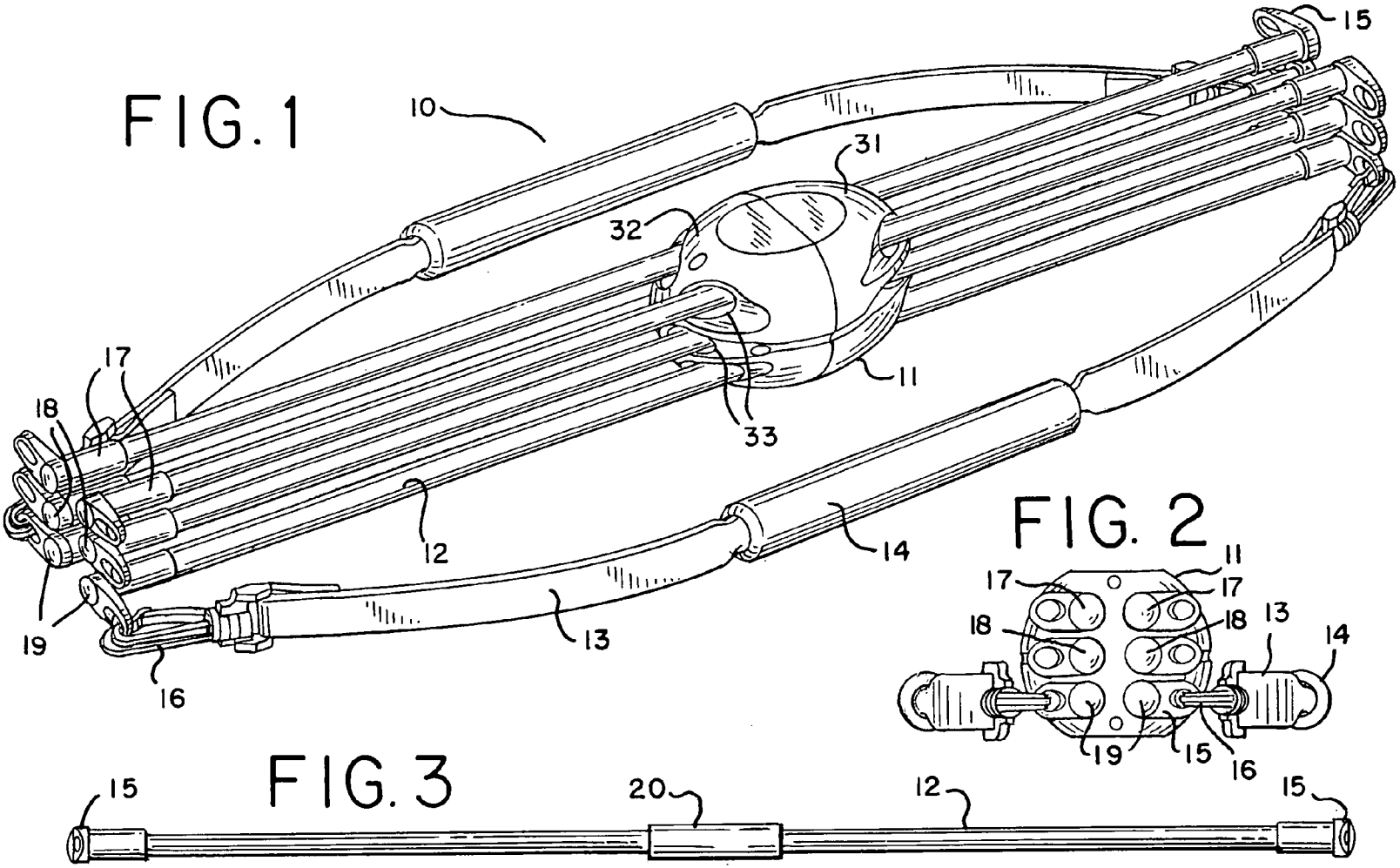
FIG. 1 is a general perspective of one embodiment of my invention.
FIG. 2 is an end view of the embodiment illustrated in FIG. 1.
FIG. 3 is a view of one embodiment of a single resilient member of the embodiment illustrated in FIG. 1.

My invention is characterized by its portable or "free standing" nature as opposed to prior art exercise equipment which typically are large, fixed machines that sit or are mounted to the floor. My device is portable and hand-held, although it can be releaseably attached to a fixed object such as a door, chair, bench, banister, hook, pole, fence, tree or any other non-movable structure. The "free standing" nature of my invention provides excellent exercise for the "core" muscles that support the skeletal structure and give us good or bad posture. In its most basic form my invention comprises two or more resilient members, a securing structure surrounding or containing the resilient members and at least two straps, each attached to one resilient member. The securing structure surrounding or containing the resilient members allows the members to flex about the structure when a user exerts force when the straps are pulled. The level of resiliency provides a counter force to the user and thus exercises the muscles used to supply the force.

FIG. 1 shows one example of the many embodiments that my invention may comprise. The portable exercise device 10 has a plurality of resilient members 12 surrounded and held in place by securing structure 11. Structure 11 can be positioned or centered around the resilient members or located off-center and can be fixedly attached to the members or slideably attached to allow it to move longitudinally along the axis of the members. Likewise, the securing structure may be as simple as a screw or bolt that fastens the members together. Although FIG. 1 shows only three sets of resilient members 12 any number of sets can be used. Members 12 can be rods, blades, springs or any other type of structure or material of construction provided it is resilient, meaning that when it is deflected or bent it provides some resistance to the force causing it to bend and that it has memory, i.e. it returns basically to its original shape and position when the force is removed. Although the shape of member is not critical to my invention, preferred shape of the members is a rod that is made of a synthetic material such as nylon or other synthetic material or combination of materials. A preferred material of construction is glass-reinforced polyester. The members may be coated with a soft sponge or other foam material to provide some protection to the user or to improve the aesthetics of the device. The diameter of the rods may vary from about ¼" to about 1" and may vary in length. Regardless of the shape, material of construction or size of resilient members 12, each member must be free to bend in a bow-like fashion about the securing structure 11 and produce a force in opposition to the force that causes the bending. It is preferred that the resilient members be paired, with each pair having a matched or equivalent resiliency. Each pair in turn would have a different resiliency than the other pairs. For example, referring to FIGS. 1 and 2, member pairs 17, 18 and 19 are comprised of two members each, where each member in the pair is identical and has the same or matched resiliency. Pair 17 is less resilient than pair 18 and pair 19, and pair 18 is less resilient than pair 19. Any reasonable number of pairs could be used in my invention.

Securing structure 11 surrounds and keeps the resilient member pairs segregated and aligned. This is best shown in FIG. 2. Securing structure 11 can be made of any material of construction and can be of any shape, or as stated above can be simply a bolt, screw clamp or any means that holds the resilient members together at a predetermined location along the longitudinal axis of the members. Preferably the securing structure is a block-like structure constructed in two pieces, shown in FIG. 1 as segments 31 and 32. Each segment contains a plurality of holes 33 where members 12 can be slideably inserted into hole 33. In one embodiment, as illustrated in FIG. 3, members 12 can include a raised section 20 positioned anywhere along members 12, preferably at the center of members 12. This raised section 20 is captured within the securing structure 11 and prevents members 12 from sliding out of structure 11. Raised section 20 can be a small length of larger diameter plastic or other material that is glued or otherwise fixed to members 12 at the desired location.

Members 12 each have at least two connectors 15 that are used to attach straps 13 through complimentary connectors 16. Although a preferred complimentary connector would be a snap hook as shown in FIGS. 1 and 2, any type of connector that can secure the strap to the member could be used. Connectors 15 are preferably located on each end of each member and can be of any design provided they allow members 12 to be pulled or bent when force is applied to straps 13 in a direction away from device 10. Preferably connectors 15 have a hole where complementary connector 16 can be easily attached. Straps 13 can be fixed in length or adjustable and have an optional handle 14 to facilitate gripping of the straps. The straps can be fashioned of any material strong enough to stand up to the forces exerted by a user of my exercise device. Preferably the straps are made of nylon and/or bungee/shock cord stock. Complimentary connectors 16 are preferably located at each end of straps 13 and can be of any design provided that it allows for releasable attachment to members 12. Alternatively, members 12 may contain snap hooks and the straps may contain connectors to engage the hooks.

My portable exercise device can be operated in a number of ways to exercise various parts of the body. First, the user should select a pair of resistant members 12 and connect strap 13 to each end. Then select what part of the body to exercise. For example, the chest and arms can be exercised by holding strap 13 by handles 14 with the device held in front of the body at chest height. Extend one arm out sideways, using the other arm to provide resistance. Bring the first arm back to the original position. Now extend the other arm, using the first arm to now provide the resistance. Repeat 10–12 times to complete one set. Selection of different member pairs can provide increased resistance. For leg exercise, a user in a sitting position can place one foot on one of the handles and grab the other with his hand. Extending the leg outward will exercise the quad muscle. These are just two of the many exercises that my portable exercise device can perform. Many modifications of my device are possible, including the addition of attachments such as various straps at handles or weights to increase the intensity of a given exercise. Therefore, the scope of my invention should be determined, not by the examples and descriptions above, but by the following claims and their legal equivalents.

I claim:

1. A handheld exercise device comprising, a) a first set of two resilient members each member having a midpoint and two ends, where the resiliency of each member in the first set is matched;

b) a second set of two resilient members each having a midpoint and two ends, where the resiliency of each member in the second set is matched and of greater resiliency than the members of the first set;

c) a releasable connector located on each end of each member in the first and second sets;

d) a block enclosing the members so that the members can flex about the block when force is exerted on both ends of each member in at least one set of members;

e) two straps that are releasably connected to at least the four ends of at least two members from the first or second set, where the two straps are of fixed and equal length and where the releasable connection to the members prevents the straps from being adjusted lengthwise; and where the exercise device is designed and constructed to be handheld and portable such that an individual can hold and operate the device without requiring any other support means for the device.

2. The exercise device of claim 1 wherein each strap has a handle positioned about mid-length therewith.

3. The exercise device of claim 1 wherein the block is secured to the members and prevents lateral movement of the members.

4. The exercise device of claim 1 further comprising at least three pairs of members, where each pair is a matched set in terms of length and resiliency and each pair has a different resiliency than the other pairs.

* * * * *